US008075086B2

(12) United States Patent
Mizes

(10) Patent No.: US 8,075,086 B2
(45) Date of Patent: Dec. 13, 2011

(54) PAPER SKEW DETECTION SYSTEM

(75) Inventor: Howard A Mizes, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 390 days.

(21) Appl. No.: 12/533,017

(22) Filed: Jul. 31, 2009

(65) Prior Publication Data

US 2011/0025743 A1 Feb. 3, 2011

(51) Int. Cl.
*B41J 29/393* (2006.01)

(52) U.S. Cl. ..... 347/19

(58) Field of Classification Search ..... 347/19
See application file for complete search history.

(56) References Cited

U.S. PATENT DOCUMENTS 4,675,696 A * 6/1987 Suzuki ..... 346/46
7,309,118 B2 12/2007 Mizes et al.
7,798,587 B2 * 9/2010 Mizes et al. ..... 347/8
7,837,290 B2 * 11/2010 Mizes et al. ..... 347/19

OTHER PUBLICATIONS

U.S. Appl. No. 12/175,879, filed Jul. 18, 2008, by Howard A. Mizes et al, and entitled Continuous Web Printing System Alignment Method.

U.S. Appl. No. 12/372,294, filed Feb. 17, 2009, by Howard A. Mizes et al, and entitled System and Method for Cross-Process Control of Continuous Web Printing System.

* cited by examiner

*Primary Examiner* — Julian Huffman

(57) ABSTRACT

A system and method that enables web paper skew detection by monitoring print head motor position. An inline full width array sensor actively tracks the alignment of the print heads across the print zone and actively moves the heads to maintain alignment. If the paper starts to skew across the print zone, a color misregistration error will be detected and the print units will be moves with respect to each other to maintain alignment. The absolute position of the print heads can be monitored by tracking the steps sent to each motor to maintain alignment.

20 Claims, 4 Drawing Sheets

PAPER SKEW DETECTION SYSTEM

The system and method disclosed herein relates to printing systems that generate images onto continuous web substrates. In particular, the disclosed embodiment relates to a method for tracking paper web skew by monitoring print head motor position.

Printers provide fast, reliable, and automatic reproduction of images. The word "printer" as used herein encompasses any apparatus, such as a digital copier, book marking machine, facsimile machine, multi-function machine, etc., which performs a print outputting function for any purpose. Printing features that may be implemented in printers include the ability to do either full color or black and white printing, and printing onto one (simplex) or both sides of the image substrate (duplex).

Some printers, especially those designed for very high speed or high volume printing, produce images on a continuous web print substrate. In these printers, the image substrate material is typically supplied from large, heavy rolls of paper upon which an image is printed instead of feeding pre-cut sheets from a bin. The paper mill rolls can typically be provided at a lower cost per printed page than pre-cut sheets. Each such roll provides a very large (very long) supply of paper printing substrate in a defined width. Fan-fold or computer form web substrates may be used in some printers having feeders that engage sprocket holes in the edges of the substrate.

Typically, with web roll feeding, the web is fed off the roll past one or more print head assemblies that eject ink onto the web, and then through one or more stations that fix the image to the web. A print head is a structure including a set of ejectors arranged in at least one linear array of ejectors, for placing marks on media according to digital data applied thereto. Print heads may be used with different kinds of ink-jet technologies, such as liquid ink jet, phase-change ink, systems that eject solid particles onto the media, etc.

Thereafter, the web may be cut in a chopper and/or slitter to form copy sheets. Alternatively, the printed web output can be rewound onto an output roll (uncut) for further processing offline. In addition to cost advantages, web printers can also have advantages in feeding reliability, i.e., lower misfeed and jam rates within the printer as compared to high speed feeding of precut sheets through a printing apparatus.

A further advantage is that web feeding from large rolls requires less downtime for paper loading. For example, a system printing onto web paper supplied from a 5 foot diameter supply roll is typically able to print continuously for an entire shift without requiring any operator action. Printers using sheets may require an operator to re-load cut sheet feeders 2 to 3 times per hour. Continuous web printing also provides greater productivity for the same printer processing speed and corresponding paper or process path velocity through the printer, since web printing does not require pitch space skips between images as is required between each sheet for cut sheet printing.

Accurately registered color images in a continuous feed printer require that the web move uniformly through the print zone. However, the web may wander in the presence of induced internal or applied external stresses. The wandering of the web may cause the paper to skew across the print path. Excessive skew has a potential for causing failures. These failures may include wrinkle of the paper web and excessive lateral movement of the print heads. Heretofore, active control of the web is handled by paper edge sensors and steering guides. Under some circumstances, paper edge sensors may not be the preferred solution. Paper edge sensors have low resolution relative to the color registration requirements. There are also sensitive to curl at the edge of the paper. They also add additional complexity to the product by requiring additional sensors.

One method for determining registration errors in the cross process direction of a printer is provided in U.S. Pat. No. 7,309,118 B2 where a first straight line is obtained by detecting line centers of a first plurality of dashes in a test pattern. A second straight line is obtained by detecting line center positions of a second plurality of dashes in the test pattern. The difference between the off-set of the first straight line and the off-set of the second straight line is used in determining registration errors.

Accordingly, in answer to the above-mentioned problem, a system and method is disclosed that enables paper skew detection by monitoring print head motor position. An inline full width array sensor actively tracks the alignment of the print heads across the print zone. A control system uses the sensed position and actuates motor commands to and actively move the heads to maintain alignment. If the paper starts to skew across the print zone, a color misregistration error will be detected and the print units will be moves with respect to each other to maintain alignment. The absolute position of the print heads can be monitored by tracking the steps sent to each motor to maintain alignment. Monitoring the web skew is this way gives sensitivities of microns rather than hundreds of microns leading to more precise control of the web skew. The web lateral position can be monitored throughout the print path at the position of every marker.

Various of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

Figure 1:
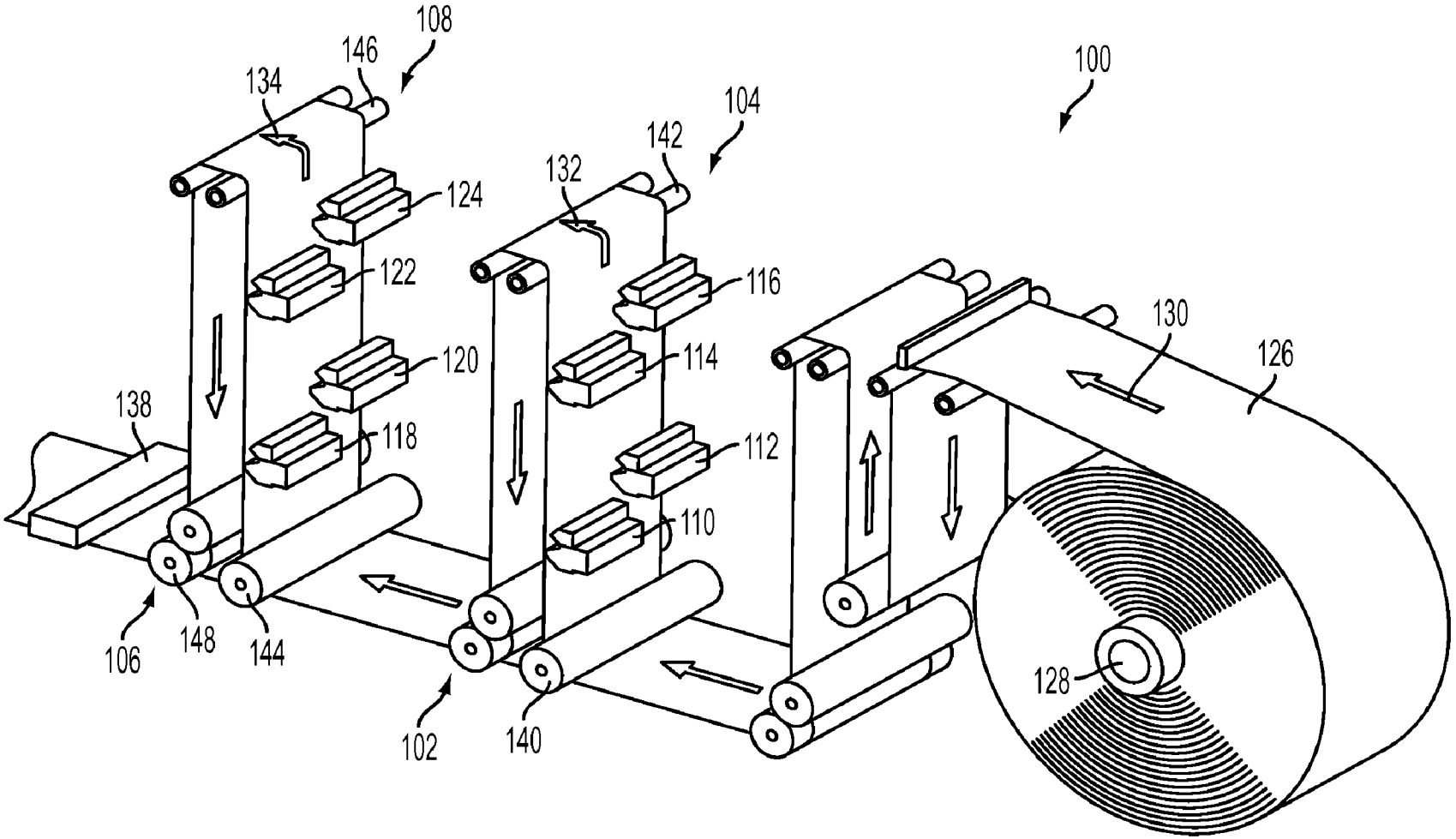
FIG. 1 depicts a partial perspective view of a continuous web tandem printing system with eight print stations.

With initial reference to FIG. 1, a continuous web printer system 100 includes four print stations 102, 104, 106, and 108. The print station 102 includes print heads 110 and 112, the print station 104 includes print heads 114 and 116, the print station 106 includes print heads 118 and 120, and the print station 108 includes print heads 122 and 124. A web of print media 126 is positioned on a spindle 128 to provide media for the continuous web printer system 100. The print media 126 is fed along a process path 130 indicated by a series of arrows.

The process path 130, which is the actual path along which the media 126 proceeds, includes process path segment 132 which is located adjacent to the print stations 102 and 104, and process path segment 134 which is located adjacent to the print stations 106 and 108. The process path segment 132 is defined by rollers 140 and 142 while the process path segment 134 is defined by rollers 144 and 146. A roller 148 defines a horizontal turn in the process path. Alignment of the print stations 102, 104, 106, and 108 with the respective process path segment 132 or 134 is controlled by an alignment control system such as disclosed in U.S. patent application Ser. No. 12/175,879, filed Jul. 18, 2008, by Howard A. Mizes et al, and entitled CONTINUOUS WEB PRINTING SYSTEM ALIGNMENT METHOD and U.S. patent application Ser.

No. 12/372,294, filed Feb. 17, 2009, by Howard A. Mizes et al, and entitled SYSTEM AND METHOD FOR CROSS-PROCESS CONTROL OF CONTINUOUS WEB PRINTING SYSTEM, both of which are included herein by reference to the extent necessary to practice the present disclosure.

Roller 148 directs the web 126 under an image on web array sensor (IOWA) 138 that is held steady by a backer roll (not shown). The IOWA sensor 138 is a full width image (FWA) contact sensor, which monitors the ink on the web 126 as the web passes under the IOWA sensor. When there is ink on the web 126, the light reflection off of the web 126 is low and when there is no ink on the web 126, the amount of reflected light is high. When a pattern of ink is printed by one or more of the heretofore-mentioned print heads, the IOWA sensor 138 may be used to sense the printed mark and provide a sensor output to a control device, such as, a computer for processing. The paper passes through another series of rolls and stations that condition the image before it is taken up by a rewinder or processed by other finishing equipment.

Figure 2A:
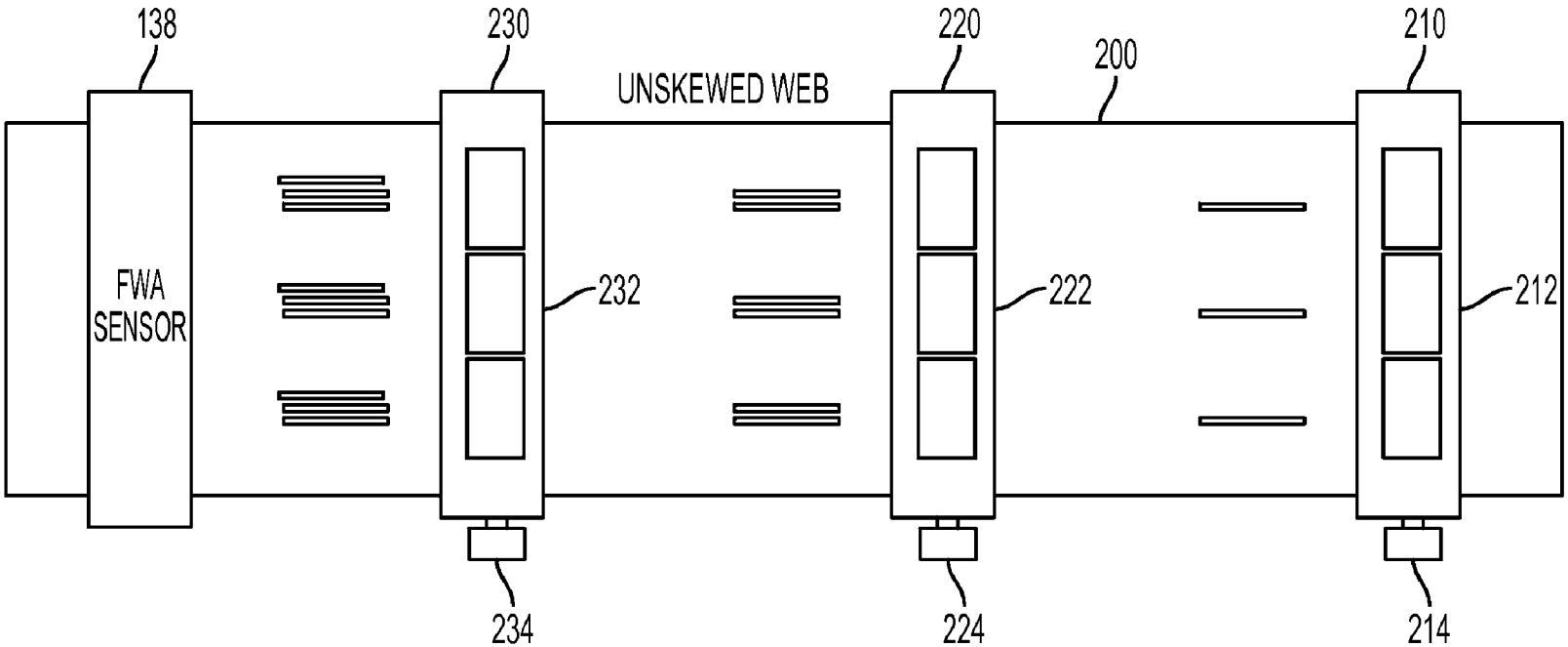
FIGS. 2A and 2B are, respectively, partial top schematic illustrations depicting an inline full width array sensor actively tracking the alignment of print heads.

In accordance with the present disclosure, the IOWA sensor 138 actively tracks the alignment of the heads across the print zone. A control system uses the sensed position and actuates motor commands to and actively move the heads to maintain alignment as illustrated, for example, in the alignment printing system of FIGS. 2A and 2B. In FIG. 2A the unskewed paper web 200 runs from the right side to the left side of the figure. The web 200 passes under a series print box units (PBUs) 212, 222 and 232 that each contains a series of markers. The PBUs are moved laterally by respective motors 214, 224 and 234. The figure shows a cyan marker 212, a magenta marker 222 and a black marker 232 in sequence. Each marker contains three print heads. As the paper passes under each marker, a subset of the nozzles of the print head creates a dash on the paper. The nozzles used to print the dashes are chosen so that the spacing between the dashes from different color print heads should be a specific spacing.

After the dashes are written, they pass under the FWA sensor. The sensor captures an image of the dashes. Through image processing the relative spacing between the dashes is determined. If the relative spacing between the dashes is equal to the expected spacing, then the print heads are aligned. If the relative spacing between the dashes differs from the expected spacing, then the print heads are misaligned. If a misalignment is found, motors 214, 224 and 234 on the PBUs move the print heads to the position that will restore alignment.

Figure 2B:
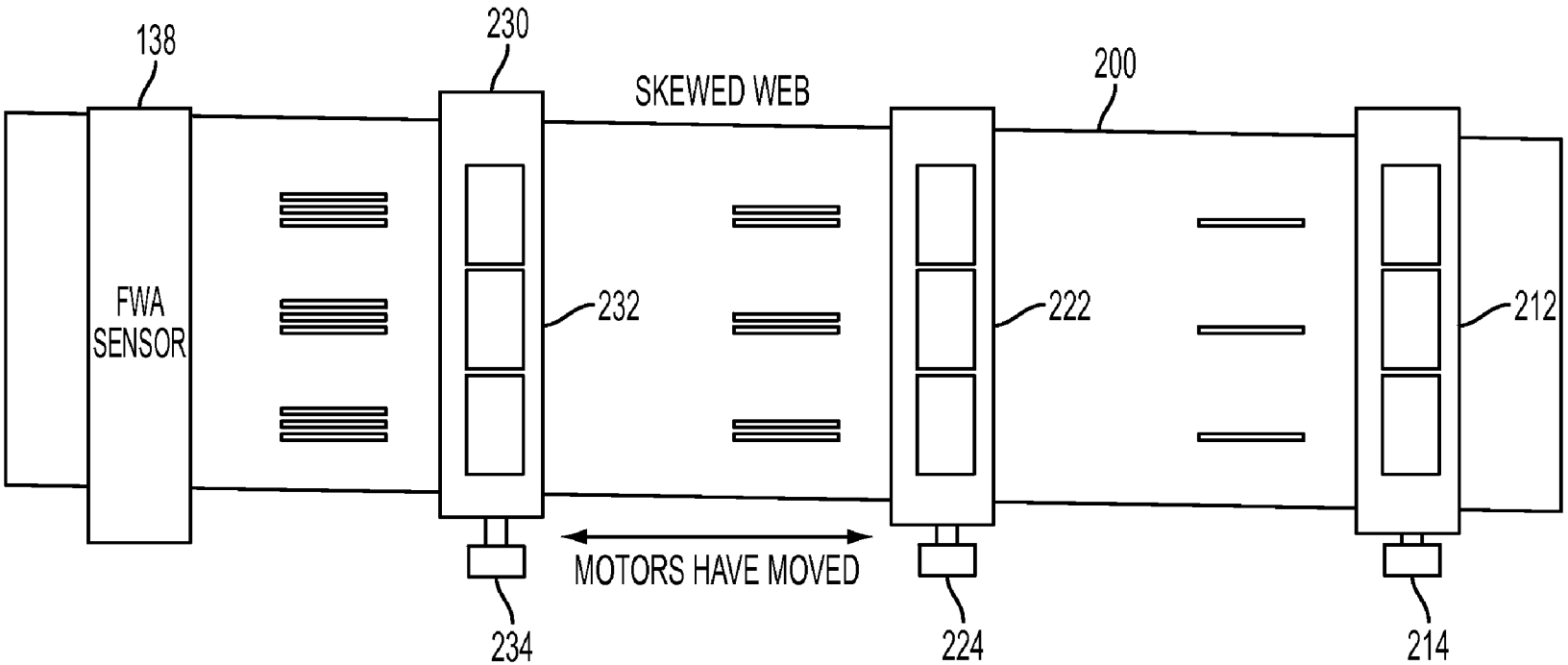

FIG. 2B shows an alignment printing system when the web is skewed. To maintain alignment, the magenta PBU 222 has been moved by motor 224 laterally along the web and the black PBU has been moved by motor 234 twice as far. This movement can be seen by the length of the motor shafts. Color registration is still maintained and will continue to be so if the motors follow the web movement. The difference between the absolute position of a motor at any time and any previous time gives the lateral movement of the paper at that point in the process direction.

It is not necessary to have a position sensor on the motor to determine its absolute position. As registration is attempted to be maintained throughout the printing process, a series of motor moves is sent to each motor. The cumulative sum of these motor moves gives the absolute position of the motor. The sensitivity of the motor can be measured during manufacturing to calibrate the distance moved to the steps sent to the motor. If the motor has backlash, the backlash can also be measured during assembly and accounted for in the cumulative sum of motor moves.

Under some conditions, it is important to know the lateral web position at multiple positions along the web path. For example, for complex print paths the web moves along multiple rolls and each roll may have a tendency to skew the print. For duplex printing, the web may pass two times through the print zone, first on the left side of the printer and second on the right side of the printer. It is especially important to sense the skew of the paper under these conditions. In the past, this required multiple paper edge sensors throughout the print zone. Now, with the FWA sensor of the present disclosure this measurement can be provided.

Figure 3:
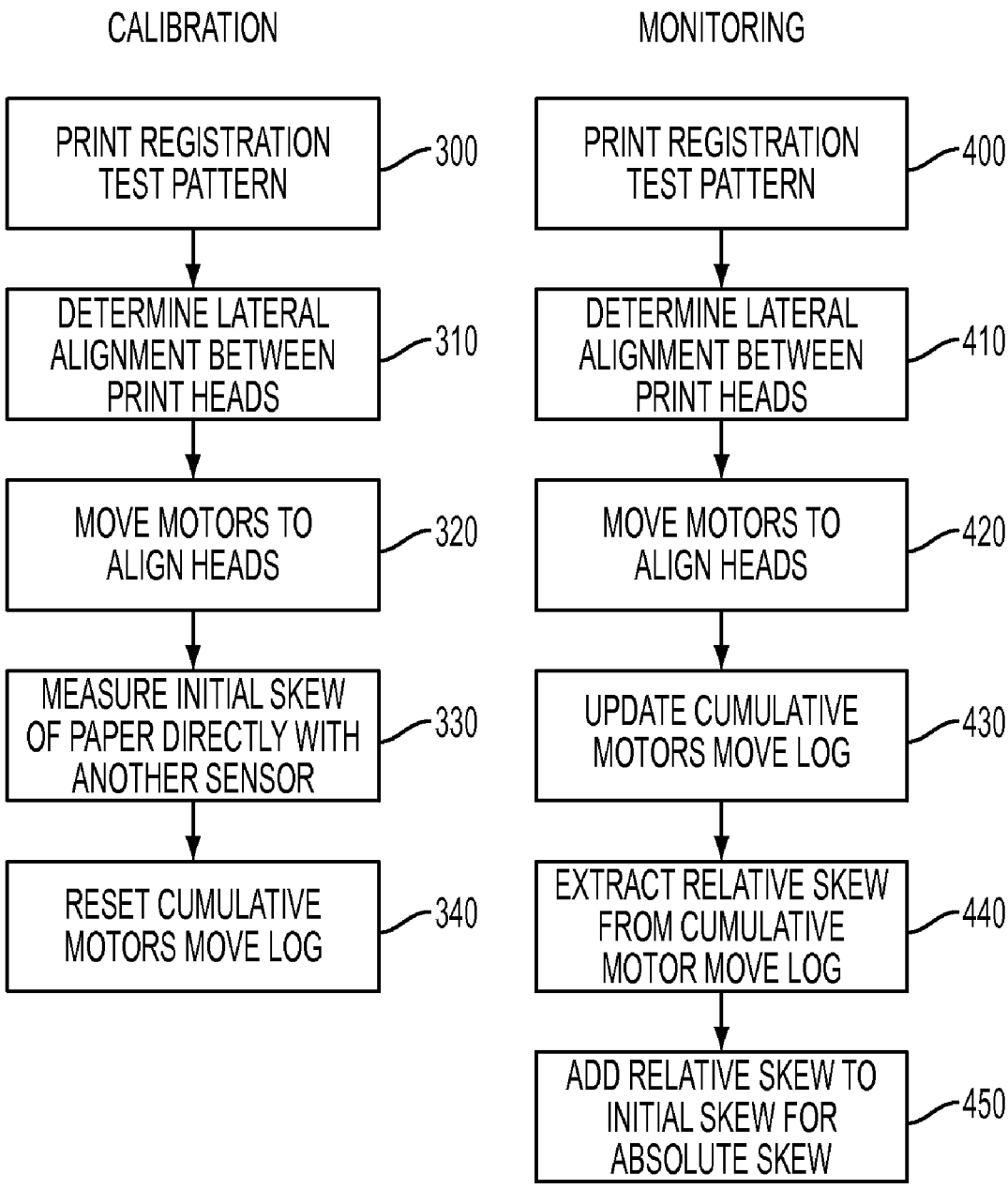
FIG. 3 shows a flow chart of the paper skew measurement process.

A flow chart of the measurement process is shown in FIG. 3. The process takes place in two steps, a calibration process which occurs one time and a monitoring process which occurs throughout the life of the printer. The calibration process begins by printing a registration test pattern in as indicated in block 300. The registration test pattern consists of a series of dashes printed from each print head. From an analysis of the test pattern in block 310 the lateral alignment between the print heads is determined. The motors attached to the PBUs are actuated in block 320 to move the print heads to bring them into alignment. With a conventional and accurate sensor, the absolute position of the paper edge relative to some absolute reference at each point along the print process is measured in block 330. While this measurement can be time consuming, it is only performed one time. This quantity is defined as the initial skew. In block 340 the cumulative motor move log is reset and the initial skew provides a reference point for subsequent paper movement.

The monitoring process begins in block 400 where the registration test pattern is again printed and then lateral alignment between the print heads is obtained in block 410. Next, the motors moves to maintain registration occur in block 420. The motor moves taken in block 420 are added to the cumulative motor move log in block 430. The cumulative motor move log gives the absolute position of each motor. The relative skew (the change in skew from the calibration process) is determined in block 440. If there are multiple print units along the print path, one can generate a plot of relative skew vs. position along the print path. Smoothing of this curve in a physically reasonable way can minimize any artifacts due to relative movement of the print head compared to the paper that is due to print head movement not related to the motor movement (such as caused by thermal expansion of the frame). In block 450, the relative skew is added to the initial skew (determined in the calibration process) to give the absolute skew of the paper.

The absolute skew of the paper can be used to take some action. If it exceeds some amount that signals an upcoming failure, one can take actions that are standard in web technology to recover from large skew. This may include adjusting roll positions, adjusting tensions, or stopping and restringing the web.

It should now be known that a method and apparatus has been disclosed for tracking we paper skew without requiring web edge sensors. Movement of the individual color marking heads perpendicular to the process is typically done to maintain color-to-color registration. By tracking the cumulative movement commands to the individual heads, the present disclosure enables the level of linear skew of the web to be estimated. As a result, improved skew sensitivity, as well as, reduced cost and complexity are obtained through the elimination of paper edge sensors.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A method for aligning print heads of a printer that deposit inks onto web paper, comprising:

A. calibrating alignment of said print heads by;

a) printing a registration test pattern;

b) determining lateral alignment between said print heads from said test pattern;

c) actuating motors connected to said print heads to move said print heads into alignment based upon said lateral alignment determination;

d) measuring initial skew of said web paper derived from c); and e) resetting a cumulative motors move log; and then B. monitoring lateral alignment of said print heads by;

a) printing a registration test pattern;

b) determining lateral alignment between said print heads from said test pattern;

c) actuating motors connected to said print heads to move said print heads into alignment based upon said lateral alignment determination;

d) updating said cumulative motor move log by adding motor movement in c);

e) extracting relative skew from said cumulative motor move log; and f) adding said relative skew to said initial skew to obtain absolute skew.

2. The method of claim 1, including providing said test pattern as a series of dashes printed from each print head and sensing said series of dashes with a full array sensor.

3. The method of claim 2, wherein measuring said initial skew includes measuring an absolute position of an edge of said web paper relative to a predetermined absolute reference at each point along a print process path of said printer.

4. The method of claim 3, wherein said calibrating alignment of said print heads is a one time occurrence.

5. The method of claim 4, wherein said calibrating alignment of said print heads takes place during manufacturing of said printer.

6. The method of claim 1, wherein said cumulative motors move log is created during manufacturing of said printer.

7. The method of claim 6, wherein said relative skew is the change in skew from the initial skew.

8. The method of claim 7, wherein said initial skew provides a reference point for subsequent web paper movement.

9. The method of claim 1, including using said absolute skew to make adjustments to said printer.

10. The method of claim 9, wherein said adjustments include stopping and restringing said paper web, adjusting roll position of rolls supporting said paper web or adjusting tension of said paper web.

11. A method for tracking paper web skew in a printer that includes a series of print heads, comprising:

providing motors connected to said print heads;

providing an initial skew in alignment of said print heads;

providing a cumulative motors move log;

printing a registration test pattern on said web paper;

sensing said test pattern with a full width array sensor;

determining lateral alignment between said print heads from said test pattern;

actuating said motors to move said print heads into alignment based upon said lateral alignment determination;

updating said cumulative motor move log by adding motor movement;

extracting relative skew from said cumulative motor move log; and adding said relative skew to said initial skew to obtain absolute skew of said web paper.

12. The method of claim 11, including providing said test pattern as a series of dashes printed from each print head.

13. The method of claim 12, wherein said initial skew includes measuring an absolute position of an edge of said web paper relative to a predetermined absolute reference at each point along a print process path of said printer.

14. The method of claim 13, wherein said providing of said initial skew is a one time occurrence.

15. The method of claim 14, wherein said providing of said initial skew of said print heads takes place during manufacturing of said printer.

16. The method of claim 15, wherein said cumulative motors move log is created during manufacturing of said printer.

17. The method of claim 11, wherein said relative skew is the change in skew from said initial skew.

18. The method of claim 17, wherein said initial skew provides a reference point for subsequent web paper movement.

19. The method of claim 11, including using said absolute skew to make adjustments to said printer.

20. The method of claim 19, wherein said adjustments include stopping and restringing said paper web, adjusting roll position of rolls supporting said paper web and adjusting tension of said paper web.

* * * * *